US010112098B2

(12) United States Patent
Smits

(10) Patent No.: US 10,112,098 B2
(45) Date of Patent: Oct. 30, 2018

(54) BICYCLE TRAINER

(71) Applicant: Tacx roerend en onroerend goed B.V., Wassenaar (NL)

(72) Inventor: Martin Smits, Wassenaar (NL)

(73) Assignee: Tacx roerend en onroerend goed B.V., Wassenaar (NL)

( * ) Notice: Subject to any disclaimer, the term of this patent is extended or adjusted under 35 U.S.C. 154(b) by 0 days.

(21) Appl. No.: 15/418,156

(22) Filed: Jan. 27, 2017

(65) Prior Publication Data

US 2017/0216698 A1 Aug. 3, 2017

(30) Foreign Application Priority Data

Jan. 28, 2016 (NL) ..... 2016178

(51) Int. Cl.
*A63B 69/16* (2006.01)
*A63B 21/02* (2006.01)
(Continued)

(52) U.S. Cl.
CPC ..... *A63B 69/16* (2013.01); *A63B 21/023* (2013.01); *A63B 21/4049* (2015.10); *A63B 22/16* (2013.01);
(Continued)

(58) Field of Classification Search
CPC ... A63B 21/023; A63B 21/4049; A63B 22/16; A63B 69/16; A63B 2208/0228;
(Continued)

(56) References Cited

U.S. PATENT DOCUMENTS 6,056,672 A * 5/2000 Carbonell Tendero ..... A63B 22/16 434/61
7,326,151 B2 * 2/2008 Peterson ..... A63B 22/16 482/57
(Continued)

FOREIGN PATENT DOCUMENTS

EP 2319592 5/2011
EP 2818214 12/2014
(Continued)

OTHER PUBLICATIONS

Translation of FR 2655862.*

*Primary Examiner* — Loan H Thanh
*Assistant Examiner* — Megan Anderson
(74) *Attorney, Agent, or Firm* — Peacock Law P.C.; Janeen Vilven

(57) ABSTRACT

A bicycle trainer for removably loading a bicycle with at least a back wheel, where the bicycle trainer comprises a floorstanding frame with a wheel supporting roller at a rear end and a fork supporting unit at a front end, wherein the fork supporting unit is pivotally supported by the floorstanding frame enabling the fork supporting unit to move, where the fork supporting unit and the floorstanding frame connect to each other with a hinge enabling movement of the fork supporting unit in a longitudinal direction of the floorstanding frame, wherein the fork supporting unit is spring-loaded with a spring at or near the hinge to provide the fork supporting unit with a preferential upright position at right angles with the floorstanding frame such that whenever the bicycle is moved, said bicycle returns to an average position on the bicycle trainer with the fork support unit perpendicular to the floorstanding frame.

1 Claim, 1 Drawing Sheet

(51) Int. Cl.
*A63B 22/16* (2006.01)
*A63B 21/00* (2006.01)

(52) U.S. Cl.
CPC ... *A63B 2069/161* (2013.01); *A63B 2069/162* (2013.01); *A63B 2069/164* (2013.01); *A63B 2069/165* (2013.01); *A63B 2069/168* (2013.01); *A63B 2208/0228* (2013.01)

(58) Field of Classification Search
CPC ..... A63B 2069/165; A63B 2069/164; A63B 2069/161; A63B 2069/162
See application file for complete search history.

(56) References Cited

U.S. PATENT DOCUMENTS

| | | | | |
|---|---|---|---|---|
| 7,604,575 | B2 * | 10/2009 | Papadopoulos ..... | A63B 69/16 482/54 |
| 7,942,790 | B2 * | 5/2011 | Papadopoulos ..... | A63B 69/16 482/61 |
| 9,295,894 | B2 * | 3/2016 | Papadopolous ..... | A63B 69/16 |
| 9,381,396 | B2 * | 7/2016 | Colan ..... | A63B 22/0605 |
| 2011/0039664 | A1 | 2/2011 | Cooper | |
| 2016/0158620 | A1 * | 6/2016 | Bauer ..... | A63B 69/16 482/61 |

FOREIGN PATENT DOCUMENTS

| | | |
|---|---|---|
| FR | 2655862 | 6/1991 |
| WO | 2007/033254 | 3/2007 |
| WO | 2007/083341 | 7/2007 |

* cited by examiner

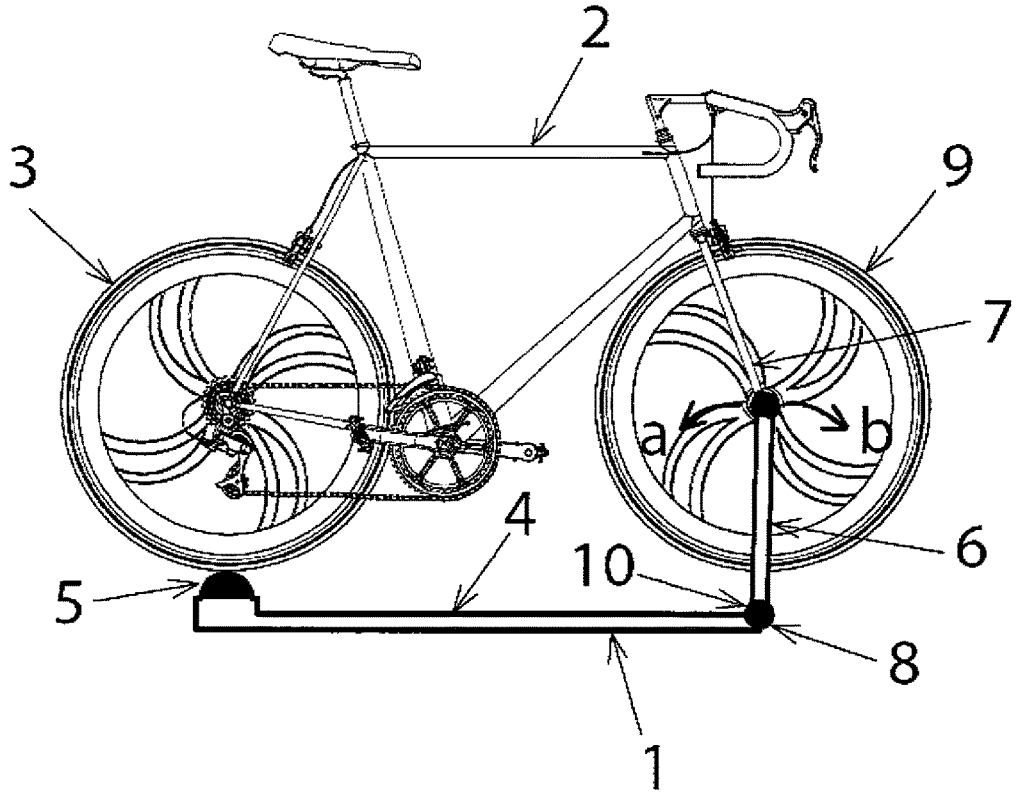
2
3
9
7
a
b
4
6
10
5
8
1

BICYCLE TRAINER

CROSS-REFERENCE TO RELATED APPLICATIONS

This application claims priority to Netherlands Patent Application No. 2016178, entitled "Bicycle Trainer", filed on Jan. 28, 2016, and the specifications and claims thereof are incorporated herein by reference.

BACKGROUND OF THE INVENTION

Field of the Invention (Technical Field)

The present invention relates to a bicycle trainer for removably loading with a bicycle that is at least provided with a back wheel, which trainer comprises a floor-standing frame with a wheel supporting roller at its rear end and a fork supporting unit at its forward end, wherein the fork supporting unit is pivotally supported by the frame enabling it to move back-and-forth.

Description of Related Art Including Information Disclosed Under 37 C.F.R. §§ 1.97 and 1.98

Bicycle trainers are known and are each year developed further to provide it with features to make the exercise experience as true as possible to resemble real-life outdoor cycling.

WO2007/083341 discloses a bicycle trainer in accordance with the preamble, which aims at reproducing the classical pendular movement from side to side of the bicycle, when the biker is cycling uphill and is therefore forced to stand on the panels for more energetic pedal thrust. This document also aims at putting the bicycle mounted on the trainer in an upward tilted position, similar to the position of the bicycle when riding a road uphill.

WO2007/033254 teaches to provide a frame of a bicycle trainer with wheels that are guided along rails in a box to permit relative motion of the bicycle trainer and the bicycle mounted thereon in a longitudinal direction of the trainer, so as to provide an additional degree of motion to more closely duplicate the natural feel of outdoor cycling. The frame of the bicycle trainer is spring-loaded to cause returning of the bicycle trainer to a central point in the box from where the backward and forward movements are executed.

EP-A-2 319 592 is applicant's earlier proposal to provide a bicycle trainer with the possibility of back-and-forth movement, wherein the supporting roll or rollers for the bicycle back wheel are movably suspended in the frame in vertical direction, and wherein the suspension of said roll or rollers are arranged to convert relative horizontal movements of the roll or rollers into vertical movements thereby compensating and/or attenuating the horizontal movements by gravity.

A recent development is disclosed in EP-A-2 818 214, which accords to the preamble and which applies a support shaft to support a fork end part of a bicycle, wherein the support shaft is loosely fitted in a hole of the frame. Along the length of the support shaft, or at least near to the end which connects to the fork end part of the bicycle, the support shaft is surrounded by an elastic material which can elastically deform when a force is applied to it by the support shaft due to a backward movement or forward movement of the bicycle on the bicycle trainer.

BRIEF SUMMARY OF THE INVENTION

It is an object of the invention to provide a simpler solution to the market for a bicycle trainer which enables its user to have a training experience which comes close or closer to real-life outdoor cycling.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawing, which is incorporated into and forms a part of the specification, illustrates one or more embodiments of the present invention and, together with the description, serves to explain the principles of the invention. The drawing is only for the purpose of illustrating one or more embodiments of the invention and is not to be construed as limiting the invention. In the drawing:

FIG. 1 is an exemplary schematic FIGURE of a bicycle trainer according to the invention.

DETAILED DESCRIPTION OF THE INVENTION

According to the invention a bicycle trainer is proposed for removably loading a bicycle with at least a back wheel, where the bicycle trainer comprises a floorstanding frame with a wheel supporting roller at a rear end and a fork supporting unit at a front end, wherein the fork supporting unit is pivotally supported by the floorstanding frame enabling the fork supporting unit to move back-and-forth, and wherein the fork supporting unit and the floorstanding frame connect to each other with a hinge enabling back-and-forth movement of the fork supporting unit in a longitudinal direction of the floorstanding frame, wherein the fork supporting unit is spring-loaded with a spring at or near the hinge to provide the fork supporting unit with a preferential upright position at right angles with the floorstanding frame such that whenever the bicycle is moved forward or backward, said bicycle is inclined to return to an average position on the bicycle trainer wherein the fork support unit is perpendicular to the floorstanding frame.

With this surprisingly simple bicycle trainer the essence of outdoor cycling is closely simulated. Particularly when higher forces are applied to the pedals and the speed at which the pedals are rotated is accelerated, the inertia of the roll or rollers on which the back wheel of the bicycle is resting causes that the bicycle will move forward on the bicycle trainer. When pedaling is relaxed the bicycle can then automatically return and move backward to its average position on the bicycle trainer. Likewise, an initial backward movement will occur due to the inertia of the roll or rollers on which the back wheel of the bicycle is resting, when the user suddenly reduces its training effort. The user will then experience a fallback as if he loses driving power when cycling uphill.

In the drawing of FIG. 1, a side view of a bicycle 2 positioned on a bicycle trainer 1 according to the invention is shown. The bicycle 2 is at least provided with a back wheel 3 and is removable from the bicycle trainer 1.

The bicycle trainer 1 comprises a floorstanding frame 4 with a wheel supporting roller 5 at its rear end and a fork supporting unit 6 at its forward end that is equipped to support a fork end part 7 of the bicycle 2. As the FIGURE shows, the front wheel 9 of the bicycle 2 can be present, but this is not essential—the front wheel 9 can also be removed. The fork supporting unit 6 is pivotally supported by the frame 4 enabling it to move back-and-forth as indicated with the arrows a and b near to the fork end part 7 of the bicycle 2.

The fork supporting unit 6 and the frame 4 connect to each other with a hinge 8 enabling back-and-forth movement of the fork supporting unit 6 according to the arrows a and b in a longitudinal direction of the frame 4. Further the fork supporting unit 6 is spring-loaded with a spring 10 at or near the hinge 8 to provide the fork supporting unit 6 with a preferential upright position at square angles with the frame 4 so as to arrange that in use whenever the bicycle 2 is moved forward or backward, said bicycle 2 is inclined to return to an average position on the bicycle trainer 1 wherein the fork support unit 6 is essentially or substantially perpendicular to the horizon. This is indeed the situation shown in the FIGURE.

Although the invention has been discussed in the foregoing with reference to an exemplary embodiment of the bicycle trainer of the invention, the invention is not restricted to this particular embodiment which can be varied in many ways without departing from the invention. The discussed exemplary embodiment shall therefore not be used to construe the appended claim strictly in accordance therewith. On the contrary the embodiment is merely intended to explain the wording of the appended claim without intent to limit the claim to this exemplary embodiment. The scope of protection of the invention shall therefore be construed in accordance with the appended claim only, wherein a possible ambiguity in the wording of the claim shall be resolved using this exemplary embodiment.

What is claimed is:

1. A bicycle trainer for removably loading a bicycle with at least a back wheel, where the bicycle trainer comprises a floorstanding frame with a wheel supporting roller at a rear end and a fork supporting unit at a front end, wherein the fork supporting unit is pivotally supported by the floorstanding frame enabling the fork supporting unit to move back-and-forth, characterized in that the fork supporting unit and the floorstanding frame connect to each other with a hinge enabling back-and-forth movement of the fork supporting unit in a longitudinal direction of the floorstanding frame, wherein the fork supporting unit is spring-loaded with a spring at or near the hinge to provide the fork supporting unit with a preferential upright position at right angles with the floorstanding frame such that whenever the bicycle is moved forward or backward, said bicycle is biased by said spring to return to an average position on the bicycle trainer wherein the fork support unit is at right angles with the floorstanding frame.

* * * * *